US005471799A

United States Patent [19]

Smeja et al.

[11] Patent Number: 5,471,799

[45] Date of Patent: Dec. 5, 1995

[54] SNOW GUARD

[75] Inventors: George C. Smeja; Michael V. Smeja, both of Crystal Lake, Ill.

[73] Assignee: Metalmaster Sheet Metal, Inc., Crystal Lake, Ill.

[21] Appl. No.: 260,692

[22] Filed: Jun. 16, 1994

[51] Int. Cl.[6] ..... E04D 13/00

[52] U.S. Cl. ..... 52/24; 52/25

[58] Field of Search ..... 52/24, 25, 26; 210/474

[56] References Cited

U.S. PATENT DOCUMENTS

| | | | |
|---|---|---|---|
| 529,774 | 11/1894 | Baird | 52/25 |
| 595,295 | 12/1897 | Fox et al. | 52/24 |
| 756,884 | 4/1904 | Parry | 52/25 |
| 1,222,953 | 4/1917 | Histand | 52/24 |
| 2,079,768 | 5/1937 | Levow | 52/25 |
| 4,650,583 | 3/1987 | Bondanini | 210/474 |

FOREIGN PATENT DOCUMENTS

| | | | |
|---|---|---|---|
| 1089220 | 3/1955 | France | 210/474 |

*Primary Examiner*—Lanna Mai

*Attorney, Agent, or Firm*—Fitch, Even, Tabin & Flannery

[57] ABSTRACT

A snow guard is formed in a medallion-like shape having a square or triangular base with corners which base is to be fixed to a building roof. Projecting upwardly from each corner of the base are triangular upstanding members to catch snow. The triangular upstanding members are flat, planar walls and have one lower edge integrally attached to base. The triangular upstanding members extend from the corners to meet at and to define a central axis at abutted inner edges of the triangles. The triangular upstanding members have upper, free-edge defining a hypotenuse for the triangle. The side edges of triangular upstanding members and edges of the base are bevelled to catch sunlight and to reflect it. The triangular-shaped upstanding members are symmetrical about the central axis allowing the snow guard to be rotated about its axis and still be effective to retain ice and snow. With a square base plate, the snow guard may be mounted with a pair of square sides parallel to metal roof seams or rotated 45° to be diagonally positioned relative to the roof seams and have a 40% increase in effective width.

11 Claims, 3 Drawing Sheets

SNOW GUARD

BACKGROUND OF THE INVENTION

This invention relates to snow guards for restraining ice and snow from sliding down inclined surfaces on buildings, particularly roofs or the like.

The commercially used snow guards at present are often in the shape of brackets with a base fixed to the roof and some even have the look a shoe horn shaped bracket fastened to the roof. Other snow guards have a pair of brackets fixed to the roof with a straight rod extending across the rods to give the roof appearance of a series of separated rods on the lower edge of the inclined roof. Snow guards are often attached to the metal roofs because the metal roof has a tendency to absorb heat and melt the snow and to then form ice sheets that can slide down the roof. The snow guards hold and retain any ice sheets that may form against sliding from the roof and causing damage.

Metal roofs often come in a wide variety of colors, such as copper, ruby, green, white, metallic, etc. Heretofore, the snow guards have been typically made of metal, which may rust or otherwise oxidize and stain the roof, or have been made of a clear transparent plastic such as Lucite. Given the various colors of metal roofs and the bracket appearance of currently used snow guards, architects, builders and building owners have been reluctant, at times, to place such snow guards on a beautiful metal roof even though they may want to do so to avoid potential liability from damage claims. Thus, there is a need for a snow guard that is highly functional and yet is aesthetically pleasing to architects, builders and building owners, for use particularly on beautifully colored metal roofs.

In some instances, the construction people have actually installed the prior art snow guards in the wrong orientation. For example, in some instances, the upstanding bracket member is installed with its upstanding wing being at the lowest point on the snow guard on the roof slope when the manufacturer intended the upstanding wing to be higher, that is, up slope on the roof. Thus, there is a need for a more foolproof design for a snow guard that will not be installed at the wrong orientation on the roof. Also, the spacing between the flanges of metal roof sheets vary significantly and it would be helpful if the same snow guard could be oriented in a first position to give a smaller width for a narrow distance between a pair of roof flanges and oriented in a second position to provide a large width for a wider distance between the roof flanges.

SUMMARY OF THE INVENTION

In accordance with the present invention, a snow guard is formed in the shape that gives the appearance of a medallion attached to the roof rather than an ugly bracket. This is achieved by a snow guard that is formed with a base from which projects a series of upstanding members that increase in height from their outer edges to a central, vertical axis at which the upstanding members meet. The preferred upstanding members are in the form of triangularly shaped plates that have one edge integral with the base and another vertical, centrally located edge joined at the central axis to the other upstanding members. The upstanding members are preferably in the shape of flat plates with open spaces being defined between the upstanding plates.

The preferred embodiment of the snow guard is symmetrical about its vertical axis so that it can be installed at any orientation and still be effective. Also, the preferred snow guard has a square base so that, when the sides of the square base are parallel to the roof seams, the width of the snow guard is equal to the width of one side of the square. On the other hand, when a wider width is desired, the snow guard is rotated 45° about the vertical axis from the above-described parallel position to a diagonal position in which the base extends diagonally between the roof flanges and the lateral distance is increased by about 40% percent.

The aesthetics of the snow guard may be improved to provide a more gem-like appearance to the snow guard by making beveled edges on the base and upstanding members to catch and reflect light and by making the snow guard of a colored plastic material of a color coordinated with the color of the roof. The beveled edges and the upstanding members provide a prismatic look to the snow guard. Thus, for example, for a green metal roof the snow guard may be a green emerald color that has the appearance of a green medallion or gem fixed to the roof, appearing more as an aesthetically appearing medallion and obscuring its function of that of serving also as a bracket to hold snow and ice from sliding from the inclined roof. For gold roofs, the snow guards may be molded with a gold color; for copper colored roofs the snow guards may be molded with a copper color, etc. to give a gem-like appearance to the medallion appearing snow guards. A transparent plastic may also be used or an opaque plastic may also be used.

CROSS-REFERENCE TO RELATED APPLICATION

Figure 1:
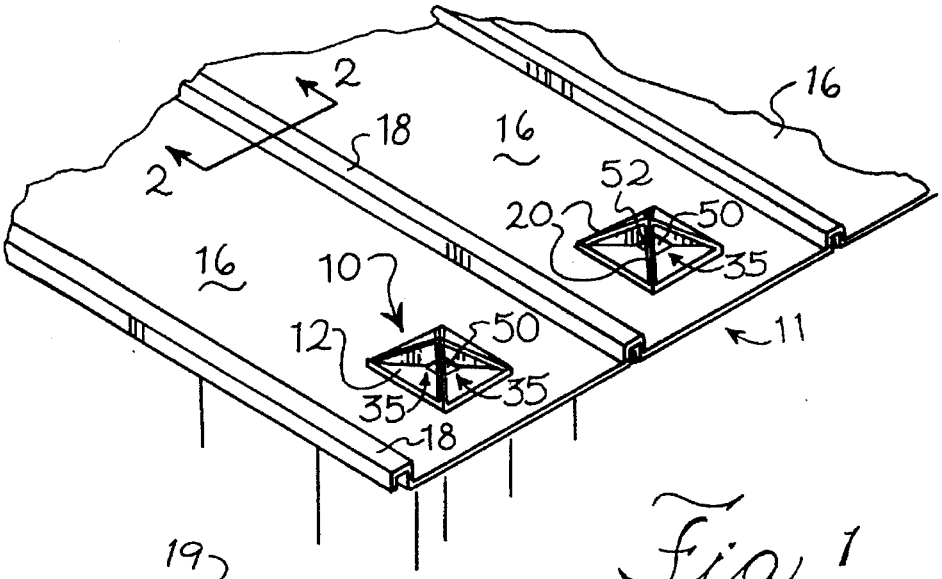
FIG. 1 is a perspective view of a snow guard mounted on a roof surface.

As shown in the drawings for purposes of illustration, the invention is embodied in a snow guard 10 which is fastened to a downwardly inclined roof 11 or a downwardly inclined portion of building facia, or the like to restrain ice and/or snow from sliding downwardly onto people, automobiles, or the like. For the sake of convenience, the term "roof" shall be used generally to mean not only a roof but also an inclined surface of a facia, covered walkway structure, or whatever the snow guard is fastened to. The snow guard has a base 12 that is fastened to the inclined roof and includes upstanding members 20 projecting upwardly from the base and for engaging the ice or snow accumulated on the roof. The roof may be made of various materials and shapes. Herein, the roof is illustrated as being a metal roof formed of a series of adjacent metal sections or panels 16 that have upwardly projecting side edges flanges 18 that are overlapped to form a seam between adjacent panels. Often a vinyl gasket 19 is positioned between the flanges 18, that have an inverted V-shaped cross-section, to act as a tight seal to prevent the leakage of water between adjacent flanges. In this type of roof, the metal sections have a fixed width, e.g., 9–24 inches with 12 inches being typical between their respective side edge flanges 18. In the length, the panels often extend quite a long way, e.g., 10–40 feet in length.

The sun heats the metal roof sections and the snow or ice between the seams tends to form, at times, into long sheets that slide down metal roofs. Sometimes, sheets as long as six feet in length may project over the roof's edge. The snow guard is intended to hold the ice and snow sheet against sliding off the roof in a big sheet or from hanging over the roof's edge and then dropping onto and damaging people and property.

Figure 2:
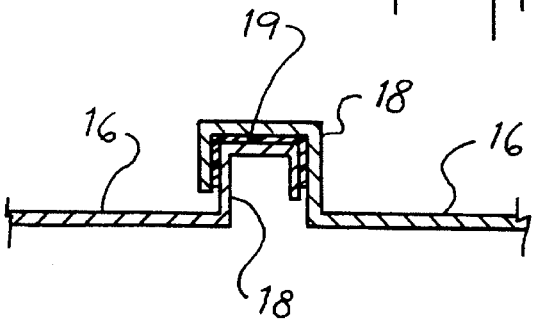
FIG. 2 is a cross-section of overlapping panel flanges of the metal roof.

In accordance with the present invention, there is provided a snow guard 10 with a medallion-like appearance that is highly functional and yet is aesthetically appearing as contrasted to the bracket or shoe horn appearance of conventional snow guards. This is achieved by having a base from which a plurality of upstanding members 20 radiate upwardly and inwardly to a central apex at a central vertical axis 22 for the snow guard and by having the base and upstanding members made of high luster, plastic and preferably with beveled edges 24 to reflect light, and of a color coordinated to the color of the roof. The preferred snow guard has a square base 12 that can be installed at any 360° angular orientation and function equally as well. Unlike conventional snow guards that should be installed in one orientation and sometimes are incorrectly installed with the wrong side facing up slope to engage and hold the snow and ice load, the preferred snow guard is relatively foolproof in installation in that there is no particular side that is to be facing up slope or down slope. The square base has an additional advantage in that when its side edges 26 are parallel to the roof panel flanges, the effective width is equal to the width of one side of the square; and, when it is desired to have a wider width for fitting between roof panel flanges spaced farther apart, the square base may be rotated 45° to increase the effective width by about 40% when a corner 28 of the base is facing up slope and another corner is facing down slope, as shown in FIG. 2.

Turning now to the illustrated snow guard 10 in greater detail, the base 10 is preferably a square, although it could be other shapes with a flat bottom wall 25 for fitting against the roof surface. The illustrated base is a flat plate that is about four inches in width and about 0.19 inches thick; these dimension being given by way of example only, and they may be varied. The base is preferably adhered to the roof surface by an adhesive. If desired, four self-tapping screws (not shown) may be also used to secure the snow guard to the roof. To receive and locate the screws, an upper wall 27 on the base is formed with conical depressions 29 to receive and guide the end of the self-tapping screw when it is eventually applied. By way of example, the depressions may be about 0.125 in diameter. Underlying and aligned with the depressions 29 in the base top wall 27 are wells 31 formed in the base bottom wall 25 to receive and hold a pool of adhesive to coat the fastener and to seal about the puncture that screw makes when it pierces the roof surface. The adhesive in the wells should provide a good seal about the screws to assure that there is no moisture leakage through roof at the locations of the holes pierced by the screws. The illustrated wells are, by way of example, 0.25 inch in diameter and about 0.075 inch in depth.

To provide the desired faceted look, the upper edges of the base 12 are beveled; and the edges of the upstanding members 20 are also beveled to reflect light. The typical bevel on the base 12 cuts off about 0.05 inch along the upper vertical side wall of the base and cuts off about 0.05 inch in the horizontal direction along the four edges of the top wall 27 of the base. To provide the faceted look to the upstanding members 20, they each have their diagonal side edge 34 formed with bevels 24 on each side of the edge. Preferably, the upstanding members are generally plates of about 0.190 inch thick; and the central flat 36 between the bevels 24 is about 0.050 inch thick between the pair of bevels 24.

Herein, the upstanding members 20 are triangular in shape with lower ends 38 integrally secured or fastened to the base plate, as by molding the base plate 12 and the four upstanding members 20 together, as in a one-piece integral molding. Each pair of upstanding members is aligned along a diagonal of the square base with the outermost and lowest ends of their diagonal side edges 34 meeting at the corners 28 of the base. The diagonal side edges 34 are, in effect, hypotenuses of each of the triangular-shaped upstanding members. The inner vertical sides 40 of the triangular-shaped upstanding members are abutted back-to-back to form a central post at the vertical axis 22 of snow guard. The illustrated height of the upstanding members is 3.00 inches; and with a 0.19 inch thick base, the total height is 3.19 inches.

The four upstanding members 20 create spaces or chambers 35 between each pair of adjacent members into which ice or snow may be collected. The ice or snow in the chambers or pockets between the upstanding members holds the same against sliding down the roof surface. To allow rain water or water from melting ice to flow through the snow guard, the center of the snow guard is formed with four openings 50, one opening 50 being formed in each of the upstanding members 20 adjacent the center axis of the snow guard. Herein, each of the upstanding members 20 is generally triangular in shape except for a small lower inner corner that has been cut off along a diagonal line 52 to form the opening 50.

Figure 3:
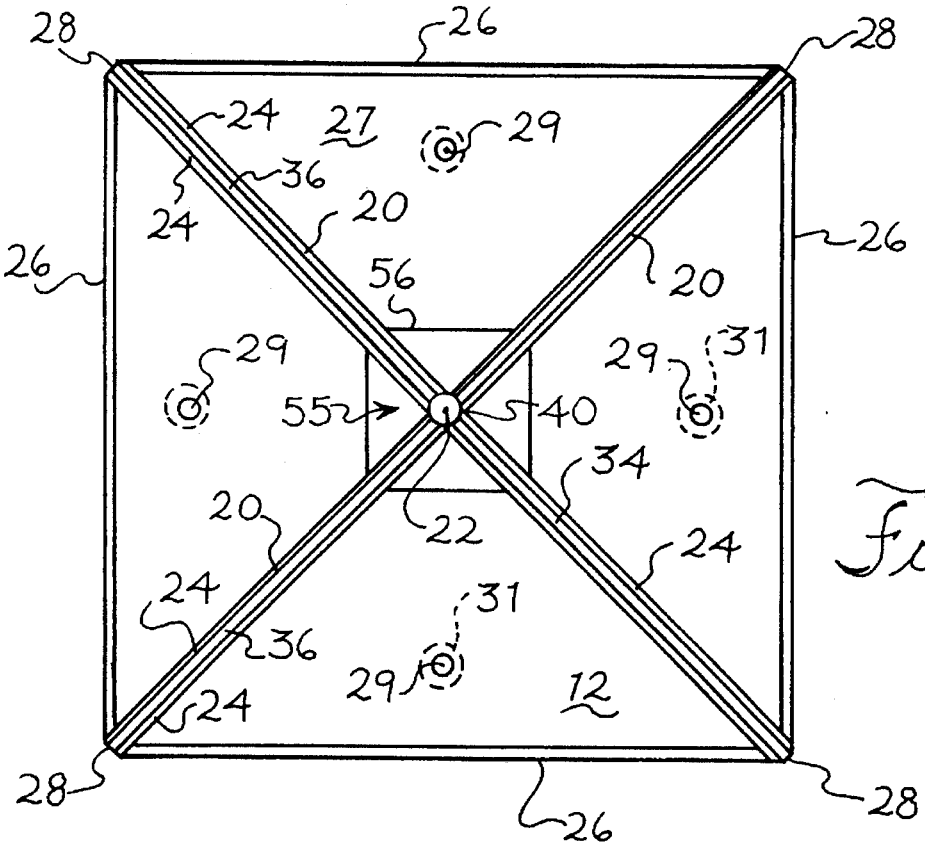
FIG. 3 is a plan view of a snow guard constructed in accordance with the preferred embodiment of the invention.
Figure 4:
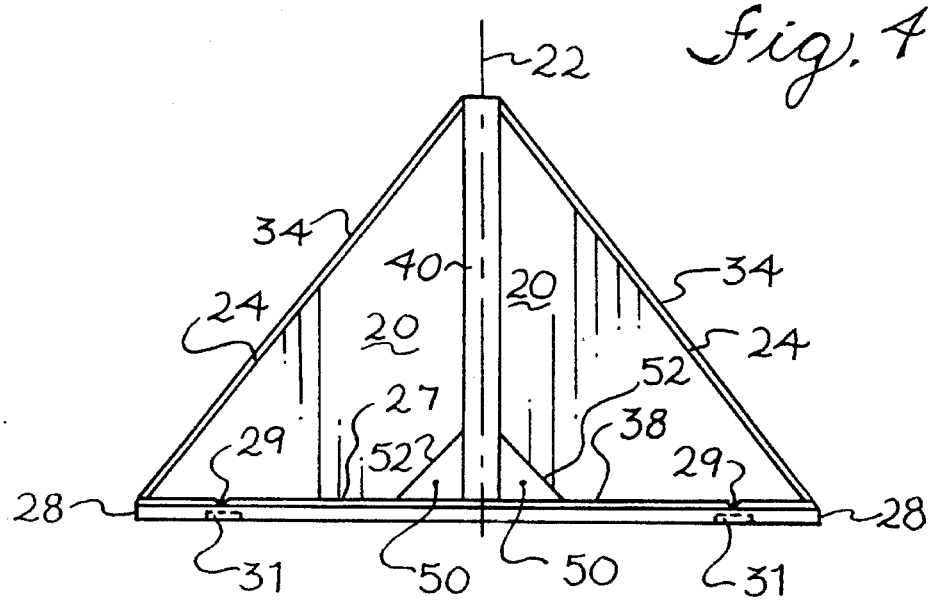
FIG. 4 is a front elevational view of the snow guard shown in FIG. 3.
Figure 5:
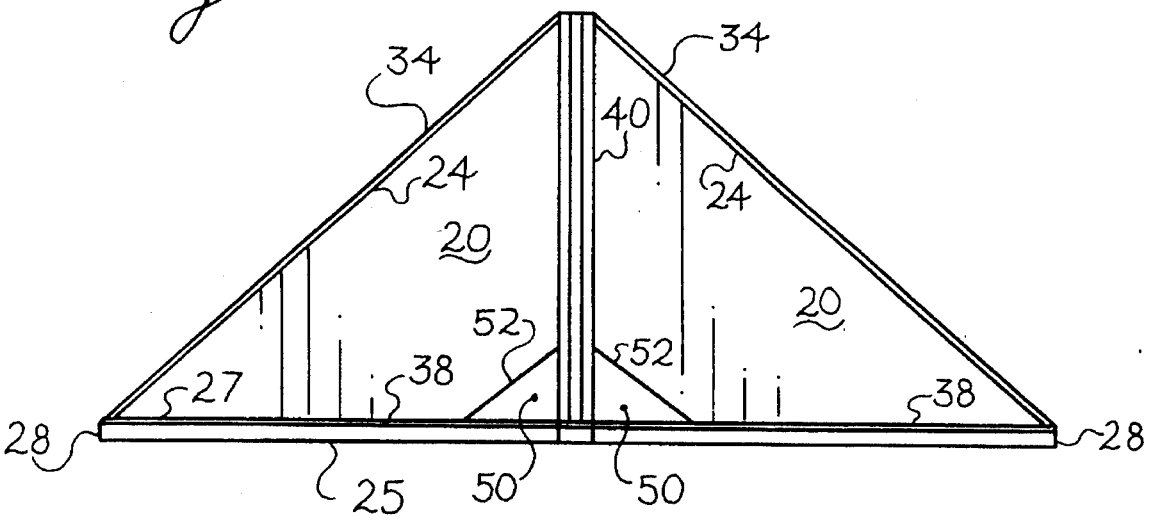
FIG. 5 is a side elevational view of the snow guard shown in FIG. 3.

The preferred construction of the snow guard is entirely or substantially entirely of one-piece molded plastic. The illustrated snow guard is molded in one piece except for a small, central square 55 (FIG. 3) that is separately molded as a separate piece and fitted into a similarly sized square opening defined by line 56 in the base 12. This square opening allows mold parts to be positioned to mold the four diagonal lines 52 and to form the four drainage holes 50. The small square 55 is separately molded and is then welded or adhered to the base 12 to fill the opening defined by the line 56; and thus, becomes part of the base 12 at the center of the snow guard.

The preferred and illustrated material is a polycarbonate such as Lexan, although it could be another plastic material of lesser cost. The preferred plastic is molded to provide a high luster finish and various color additives are added to give the desired color. The high luster finish, the beveled edges and four upstanding members meeting at the central axis 22 of a square base provide a very distinctive medallion-like appearance that is intended to be taken as an ornamentation to the roof, rather than the bracket-look of snow guards now in use. The preferred color plastics are translucent to light and, in fact, have a bright appearance. However, the plastics may be made to be opaque and not bright.

Figure 6:
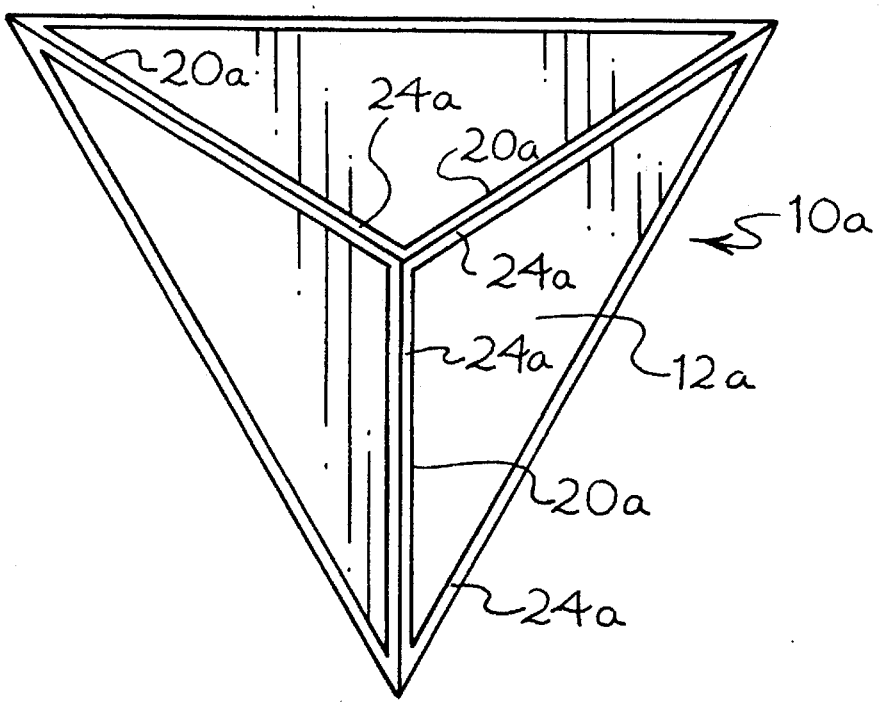
FIG. 6 is a plan view of another embodiment of a triangularly-shaped snow guard.
Figure 7:
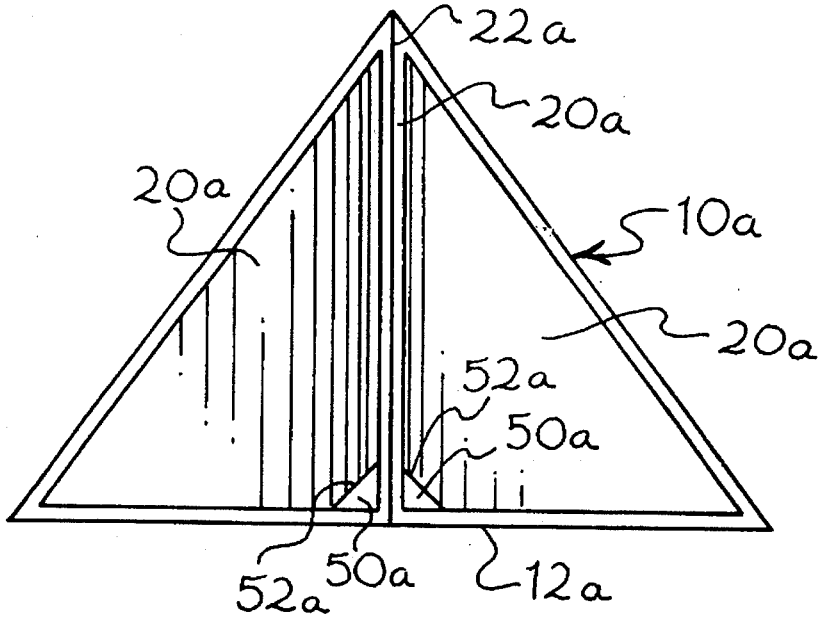
FIG. 7 is an elevational view of the snow guard shown in FIG. 6.

Although the snow guard shown in FIGS. 1–6 has a square base 12 with four upstanding members 20, it is possible to make the base in other shapes and with other numbers of upstanding members 20. For instances, as shown in FIGS. 6 and 7, there is a snow guard **10*a* with a base 12*a*** of triangular shape, and there are three upstanding members 20*a* meeting a central vertical axis 22*a* of the snow guard. The edges of the base and upstanding members are provided with bevels 24*a*. Each of the upstanding members 20*a* is formed with an opening 50*a*, which is defined a diagonal cutoff of the interior corner of the upstanding member along a diagonal line 52*a*. Thus, it is clear that the medallion look snow guard may be providing a different number of sides and upstanding member illustrated herein and still fall within the purview of this invention.

What is claimed is:

1. A snow guard for retaining ice and snow from freely sliding along a roof surface, said snow guard comprising:

a substantially flat base made of plastic for securing to the roof surface;

the base having a plurality of spaced corners;

a plurality of upstanding members made of plastic integrally connected at the lower edges thereof to the base to retain ice and snow and extending upwardly in intersecting planes;

the lower edges of the upstanding members extending into and terminating adjacent corners of the base, upstanding inner edges on the upstanding members adjoining and defining a central vertical axis for the base, and walls on the upstanding members projecting outwardly from the central vertical axis along the base to retain ice and snow.

2. A snow guard in accordance with claim 1 in which each of the upstanding members is substantially identical in shape and size, and in which the upstanding members are spaced from one another at equal angles.

3. A snow guard in accordance with claim 1 in which the upstanding members are triangular in shape with a lower edge of the triangle being attached integrally to the base, each triangle having an outer, free sloped edge defining a hypotenuse of the triangle.

4. A snow guard in accordance with claim 3 in which the base is planar and flat, and in which the triangular, upstanding members are each planar and flat.

5. A snow guard in accordance with claim 1 in which the base is in the shape of a square, and each of the upstanding members is triangular in shape.

6. A snow guard in accordance with claim 1 in which the base is in the shape of a triangle, and each of the upstanding members is triangular in shape.

7. A snow guard in accordance with claim 1 in which wells are formed in the underside of the base to receive an adhesive therein.

8. A snow guard in accordance with claim 7 in which fastener-receiving depressions are formed in the upper side of the base over the wells to allow adhesive to surround the fasteners to seal moisture against leaking through the roof where it has been pierced by fasteners.

9. A snow guard in accordance with claim 1 in which the base and upstanding members are made of plastic, the base having edges, the upstanding members having edges, and said edges on the base and upstanding members are beveled to catch light to provide a gem, medallion like look to the snow guard.

10. A snow guard in accordance with claim 1 including drainage openings in the upstanding members adjacent the central vertical axis of the snow guard to allow water to flow through the snow guard.

11. A snow guard for retaining ice and snow from freely sliding along a roof surface, said snow guard comprising:

a substantially flat base plate made of plastic for securing to the roof surface, and having a central axis in the middle of the base plate;

a plurality of upstanding, triangular, flat plates made of plastic integrally connected at the lower edges thereof to the base plate to retain ice and snow and extending upwardly in intersecting planes;

upstanding inner edges on the upstanding triangular plates adjoining and meeting at the central axis of the base plate, the upstanding members projecting outwardly from the central vertical axis along the base to retain ice and snow;

each of the upstanding plates being substantially identical in shape and size, the upstanding plates being spaced from one another at equal angles;

each triangular-shaped plate having an outer, free sloped edge defining a hypotenuse for each triangular-shaped plate;

the triangular upstanding plates defining a symmetrical construction about the vertical axis of the base plate; and the snow guard being effective in any rotated position about the symmetrical, vertical axis of the base plate to retain ice and snow.

* * * * *